US008758036B2

(12) United States Patent
An et al.

(10) Patent No.: US 8,758,036 B2
(45) Date of Patent: Jun. 24, 2014

(54) ELECTRICAL CONNECTOR ASSEMBLY HAVING CABLE CONNECTOR ROTATABLY ASSEMBLED THEREON

(75) Inventors: Alex Lon An, San Jose, CA (US); Darrell Lynn Wertz, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 63 days.

(21) Appl. No.: 13/556,170

(22) Filed: Jul. 23, 2012

(65) Prior Publication Data

US 2014/0024229 A1 Jan. 23, 2014

(51) Int. Cl.
*H01R 4/50* (2006.01)

(52) U.S. Cl.
USPC ..... 439/342; 439/331

(58) Field of Classification Search
USPC ..... 439/65, 67, 331, 342, 493, 495
See application file for complete search history.

(56) References Cited

U.S. PATENT DOCUMENTS

| | | | | |
|---|---|---|---|---|
| 5,530,291 | A * | 6/1996 | Chan et al. | 257/723 |
| 6,144,559 | A * | 11/2000 | Johnson et al. | 361/760 |
| 6,659,802 | B1 * | 12/2003 | Lwee | 439/630 |
| 7,163,406 | B2 * | 1/2007 | Ma | 439/70 |
| 7,244,137 | B2 * | 7/2007 | Renfro et al. | 439/342 |
| 7,248,481 | B2 * | 7/2007 | Trobough | 361/785 |
| 7,261,580 | B1 * | 8/2007 | Secora | 439/341 |
| 7,517,228 | B2 * | 4/2009 | Baskaran et al. | 439/67 |
| 7,654,829 | B1 * | 2/2010 | Chuang et al. | 439/67 |
| 8,353,708 | B2 * | 1/2013 | Hsu | 439/67 |
| 2009/0023330 | A1 * | 1/2009 | Stoner et al. | 439/493 |
| 2011/0287639 | A1 | 11/2011 | Hsu | |

* cited by examiner

*Primary Examiner* — Thanh Tam Le
(74) *Attorney, Agent, or Firm* — Wei Te Chung; Ming Chieh Chang

(57) ABSTRACT

An electrical connector assembly (100) for electrically connecting a CPU (5) with a printed circuit board (8) and includes a housing assembly (9) with a number of contacts (12) received therein and a cable connector (71) rotatably assembled to the housing assembly (9), the cable connector (71) includes a gate (712) rotatably assembled to the housing assembly (9) and a number of terminals (711) assembled in the gate (712), the gate (712) includes a shaft (7120) assembled to the housing assembly (9) and the gate (712) rotates around the shaft (7120).

19 Claims, 7 Drawing Sheets

ELECTRICAL CONNECTOR ASSEMBLY HAVING CABLE CONNECTOR ROTATABLY ASSEMBLED THEREON

BACKGROUND OF THE INVENTION

1. Field of the Invention

The present invention relates to an electrical connector assembly, and more particularly to an electrical connector assembly having a cable connector rotatably assembled to the electrical connector.

2. Description of Related Art

U.S. publication No. 20090023330 published to stoner on Jan. 22, 2009 discloses a conventional electrical connector assembly to use a cable to establish a connection path between two CPUs. The cable is assembled to a cable connector, and the cable connector is assembled to the CPUs. The CPU comprises a plurality of conductive pads on an upper surface thereof. The cable connector comprises a plurality of contacts electrically connecting with the conductive pads of the CPU.

The cable connector comprises a plurality of posts, and the CPU comprises a plurality of holes corresponding to the posts. When the cable connector is assembled to the CPU, the posts are received in the holes to position the cable connector on the CPU. When want to remove the CPU, one must draw the cable connector and make the post break away from the hole of the CPU. The cable connector matches with the CPU tightly to make a robust electrical connection between the cable and the CPU. So, there need a large force to draw the cable connector away from the CPU.

Hence, it is desirable to provide an improved electrical connector assembly to overcome the aforementioned disadvantages.

SUMMARY OF THE INVENTION

Accordingly, an object of the present invention is to provide an electrical connector assembly having an cable connector rotatably assembled on the electrical connector.

According to one aspect of the present invention, an electrical connector assembly for electrically connecting a CPU with a printed circuit board and includes a housing assembly with a number of contacts received therein and a cable connector rotatably assembled to the housing assembly, the cable connector includes a gate rotatably assembled to the housing assembly and a number of terminals assembled in the gate, the gate includes a shaft assembled to the housing assembly and the gate rotates around the shaft.

Other objects, advantages and novel features of the invention will become more apparent from the following detailed description when taken in conjunction with the accompanying drawings, in which:

DETAILED DESCRIPTION OF THE INVENTION

Figure 1:
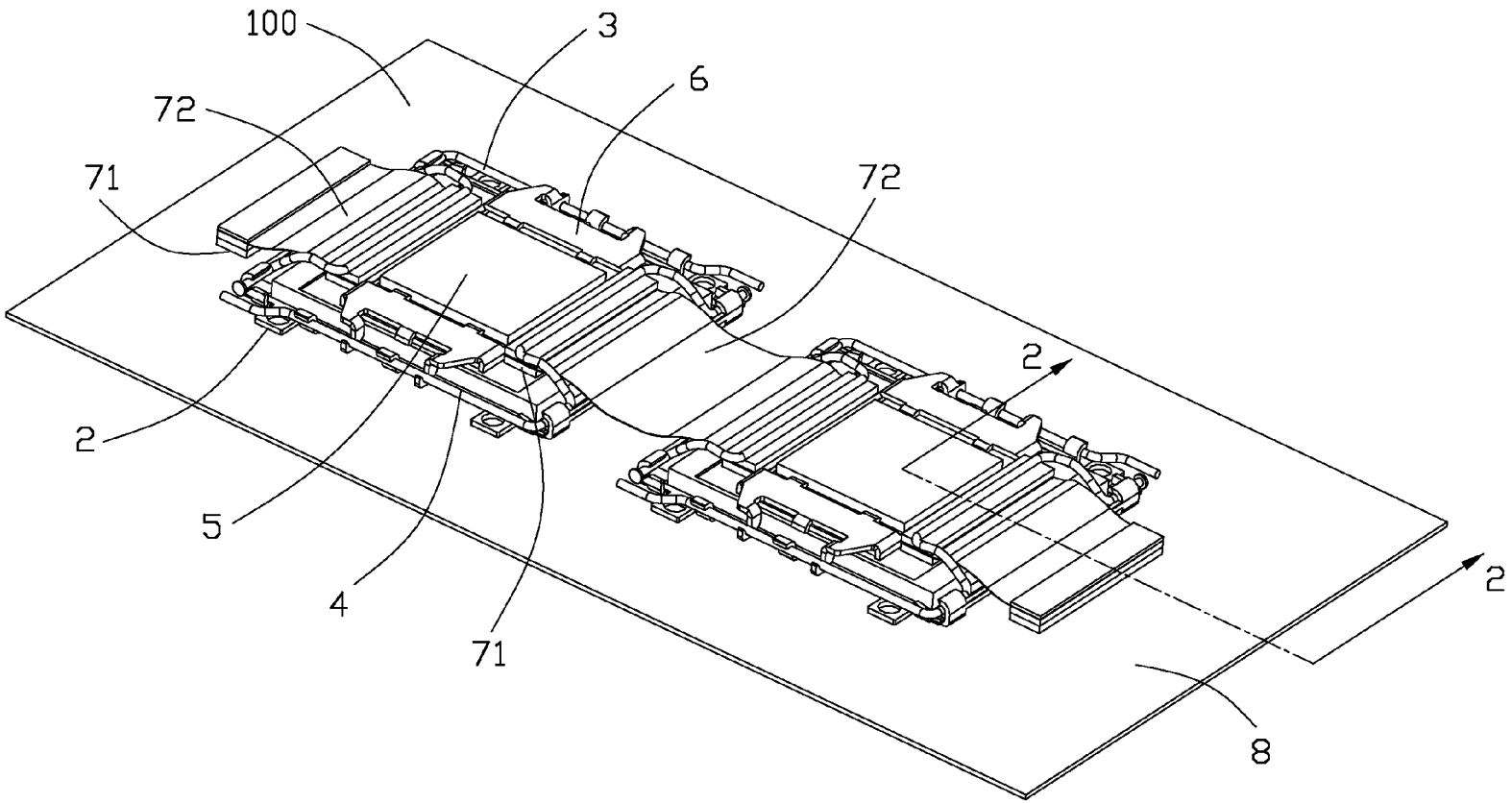
FIG. 1 is an assembled, isometric view of a preferred embodiment of an electrical connector assembly, showing a cable connecting with two CPUs seating on two electrical connectors.
Figure 2:
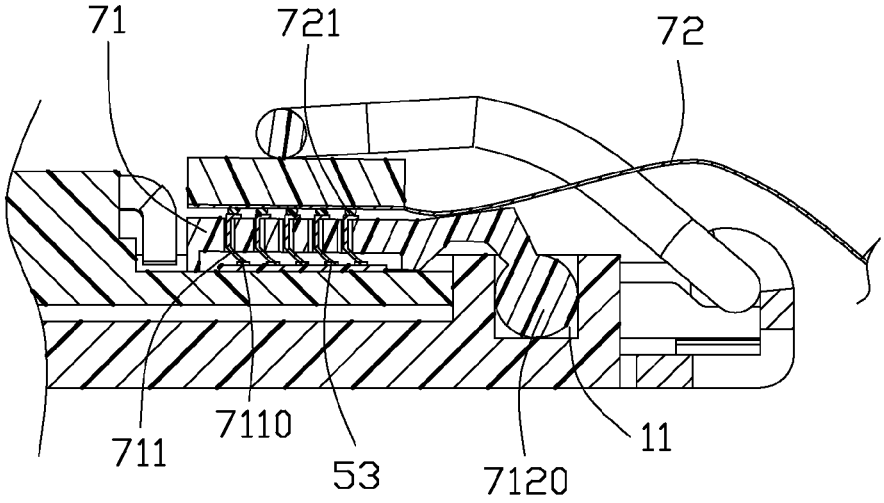
FIG. 2 is a cross-sectional view of the electrical connector assembly taken along line 2-2 in FIG. 1.
Figure 3:
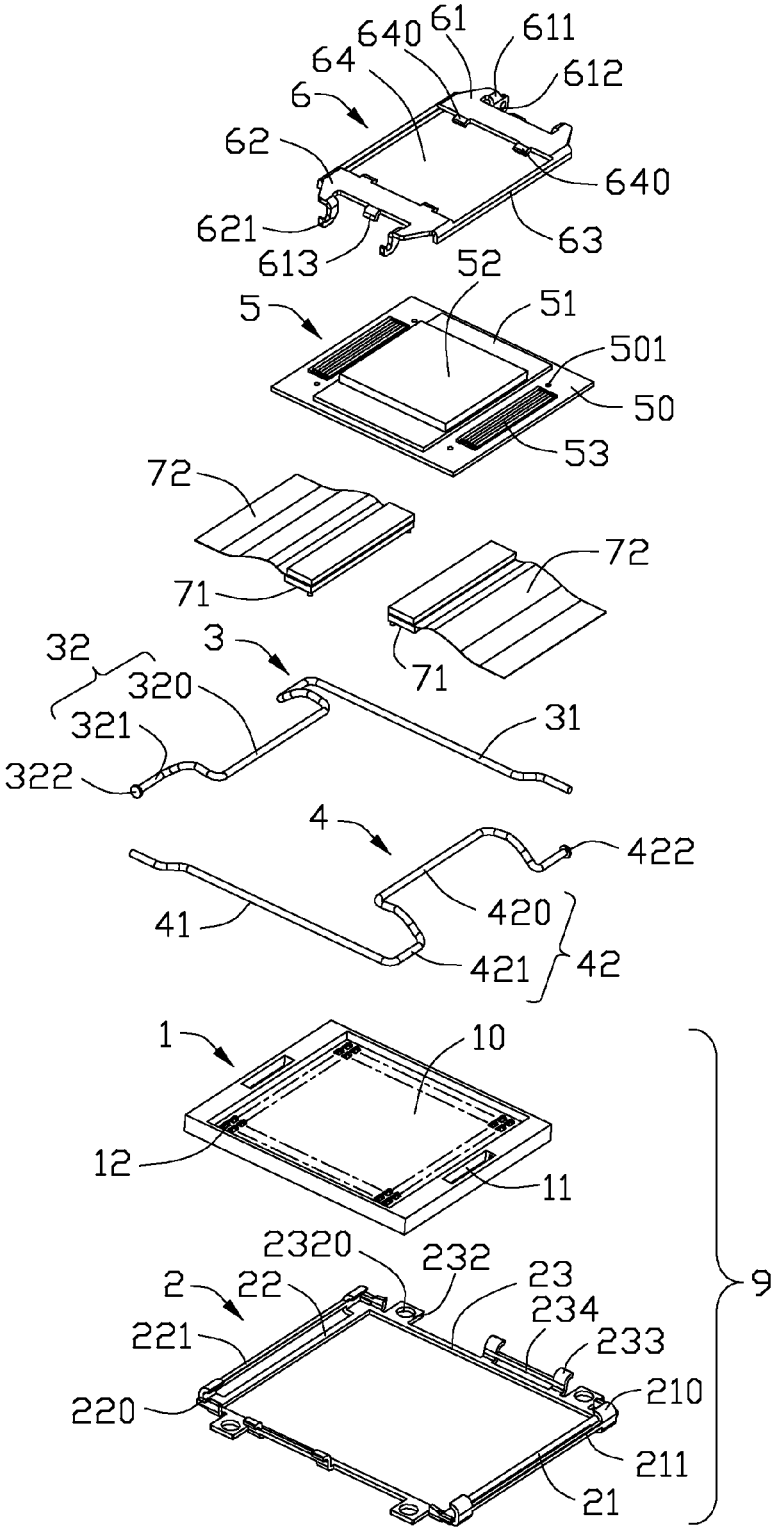
FIG. 3 is an exploded, perspective view of the electrical connector assembly shown in FIG. 2.

Reference will now be made to the drawings to describe the present invention in detail.

FIGS. 1 to 4 illustrate an electrical connector assembly 100 in accordance to a preferred embodiment of the present invention, the electrical connector assembly 100 is used for electrically connecting a central processing unit (CPU) 5 with a printed circuit board (PCB) 8 and achieves high-speed signal transmissions between two CPUs 5 through cable 72. The electrical connector assembly 100 comprises an electrical connector (not labeled), a CPU 5 assembled to the electrical connector and a cable connector 71 assembled to the electrical connector and a cable 72 assembled to the cable connector 71.

The electrical connector comprises a housing assembly 9, a first load lever 4 and a second load lever 3 locating on two opposite sides of the housing assembly 9 and a cover 6 assembled to the first load lever 4 and the second load lever 3. The housing assembly 9 comprises an insulative housing 1 with a plurality of contacts 12 received therein, a stiffener 2 surrounding the insulative housing 1. The first load lever 4 and the second load lever 3 are assembled to two ends of the stiffener 2. The insulative housing 1 defines a cavity 10 for receiving the CPU 5, a sunken portion 11 near the cavity 10 and a recess 110 connected with the sunken portion 11.

The stiffener 2 comprises a first end 21, a second end 22 and a pair of third ends 23 connecting the first end 21 and the second end 22. The first end 21 comprises a pair of first holding portions 210 extending upwardly and curvedly from the first end 21 and a first connecting portion 211 connecting the pair of first holding portions 210. The first connecting portion 211 is used to strength the pair of first holding portions 210. The second end 22 comprises a pair of second holding portions 220 extending upwardly and curvedly and a second connecting portion 221 connecting the pair of second holding portions 220. The second connecting portion 221 is used to strength the pair of second holding portions 220. The third end 23 comprises a pair of positioning portions 232 extending outwardly, a pair of interlock portions 233 extending upwardly and curvedly and a third connecting portion 234 connecting the pair of interlock portions 233. Each of the positioning portions 232 defines a hole 2320. The third connecting portion 234 is used to strength the pair of interlock portions 233. The electrical connector is positioned to the PCB 8 by a positioning member (not shown) going through the hole 2320.

The first load lever 4 comprises a first operation portion 41, a first locating portion 42 connecting with the first operation portion 41 and a first stop portion 422 at the end of the first locating portion 42. The first locating portion 42 comprises a first press portion 420 in the middle thereof and a pair of first retention portions 421 at the two sides of the first press portion 420. When the first load lever 4 is assembled to the stiffener 2 and in a closed position, the pair of first retention portions 421 interlocks with the pair of first holding portions 210 of the stiffener 2, the first stop portion 422 is thicker than the first retention portion 421 to prevent the horizontal movement of the first load lever 4. Thus, the first load lever 4 is securely positioned on the stiffener 2.

The second load lever 3 has a same structure with the first load lever 4 and comprises a second operation portion 31, a second locating portion 32 connecting with the second operation portion 31 and a second stop portion 322 at the end of the second locating portion 32. The second locating portion 32 comprises a second press portion 320 in the middle thereof and a pair of second retention portions 321 at the two sides of the second press portion 320. When the second load lever 3 is assembled to the stiffener 2 and in a closed position, the pair of second retention portions 321 interlocks with the pair of second holding portions 220, the second stop portion 322 is thicker than the second retention portion 321 to prevent the horizontal movement of the second load lever 3. Thus, the second load lever 3 is securely positioned on the stiffener 2.

The cover 6 comprises a front end 61, a rear end 62 and a pair of side portions 63 connecting the front end 61 and the rear end 62. The front end 61, the rear end 62 and the side portions 63 form a space 64 to permit the CPU 5 going through. Both of the front end 61 and the rear end 62 define a pair of engage portions 640 extending into the space 64 for pressing on the CPU 5 and a restrict portion 613 extending outwardly. The restrict portions 613 locates on the outside of the insulative housing 1 to guide the cover 6 being assembled to the insulative housing 1. The front end 61 comprises a pair of retention portions 611 extending from the two ends of the front end 61. Each of the retention portions 611 defines a through hole 612. The second operation portion 31 of the second load lever 3 goes through the through holes 612 to position the cover 6 on the second load lever 3. The rear end 62 comprises a pair of tongue portions 621 extending outwardly to be pressed by the first operation portion 41 of the first load lever 4.

The CPU 5 comprises a body portion 50, a first step portion 51 extending upwardly from the body portion 50, a second step portion 52 extending upwardly from the first step portion 51, a plurality of conductive contacts 53 locating on the two sides of the first step portion 51 and a pair of position holes 501 near the conductive contacts 53. The cable connector 71 comprises a gate 712 rotatably assembled to the insulative housing 1 and a plurality of terminals 711 assembled in the gate 712 to connect with the conductive contacts 53 of the CPU 5. The gate 712 comprises a body portion 7122 for receiving the terminals 711 and a shaft 7120 connected to the body portion 7122. There is a protruding point 7121 at the two ends of the shaft 7120 and a pair of post 7124 extending downwardly from the body portion 7122. The cable 72 is soldered to the terminals 711 of the cable connector 72 and an electrical path between the cable 72 and the CPU 5 is established. The terminals 711 of the cable connector 71 has a spring contact portion 7110 deformed in a vertical direction to engage with the conductive pads 53, thus to make a robust electrical connection therebetween.

Figure 4:
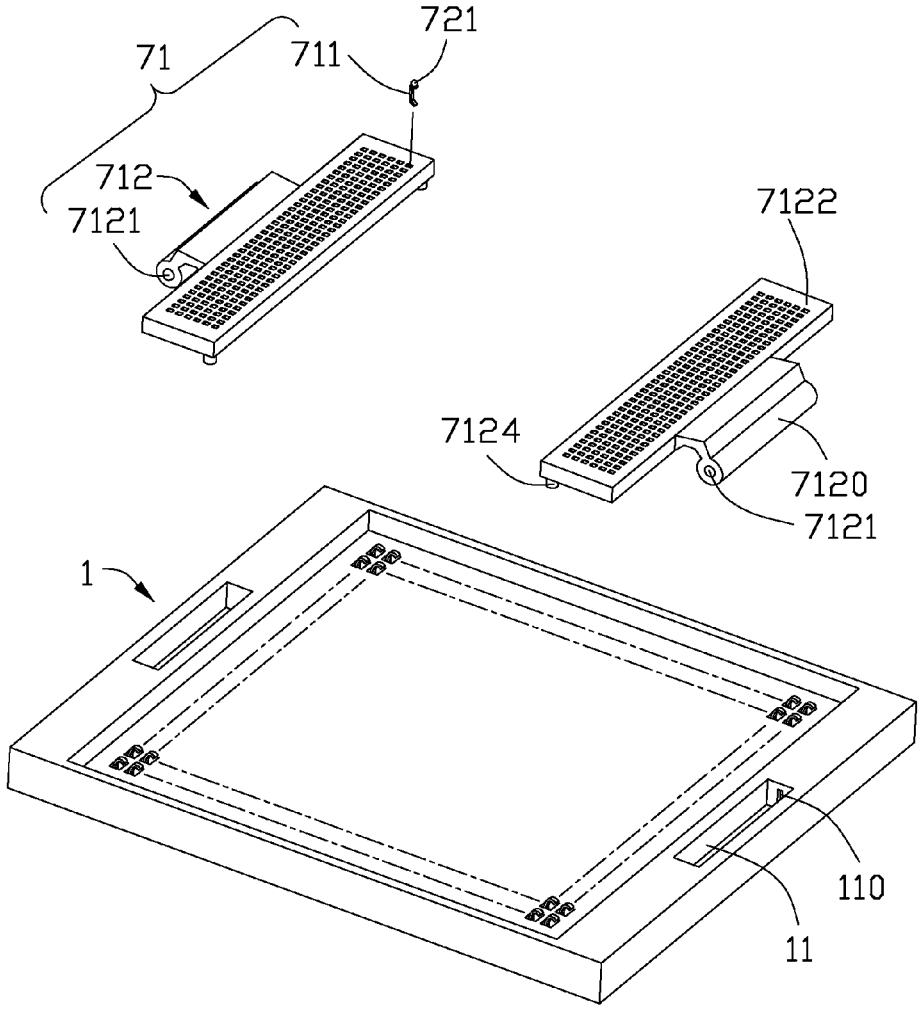
FIG. 4 is an exploded, perspective view of the insulative housing and the cable connector shown in FIG. 2.
Figure 5:
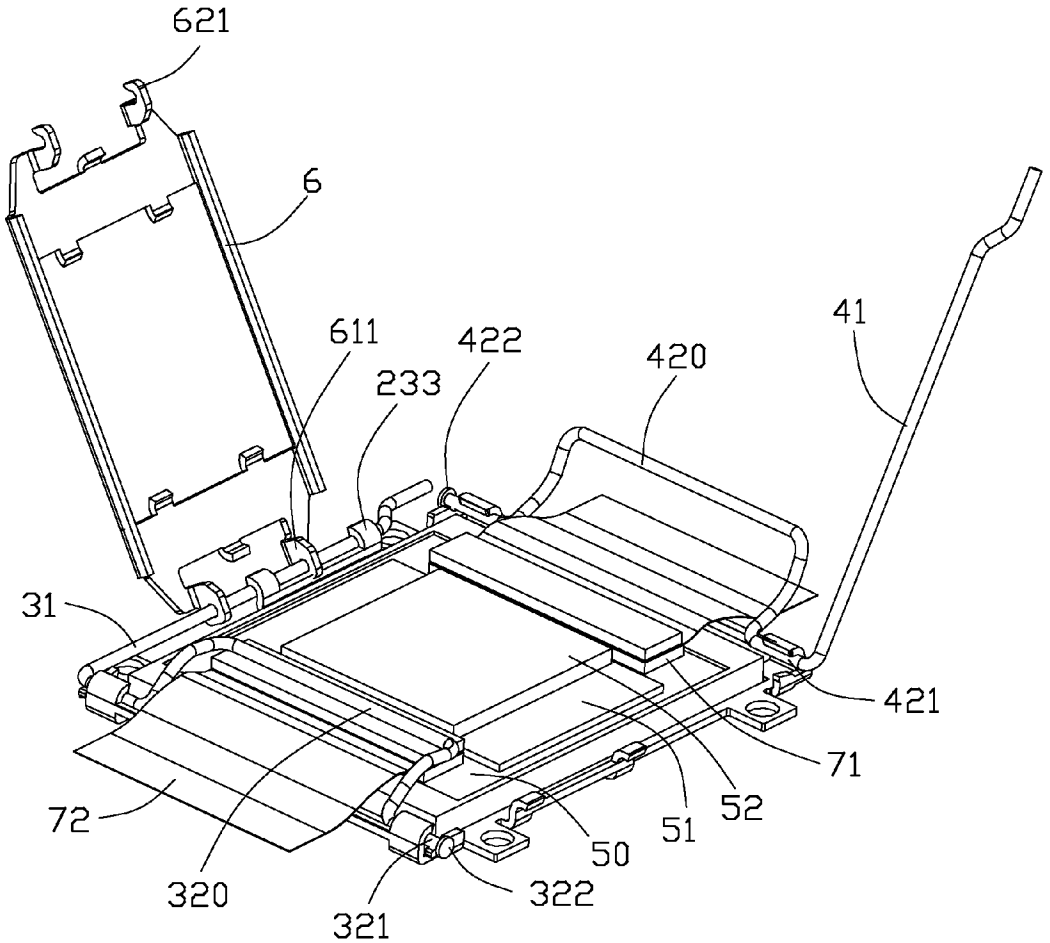
FIG. 5 is an assembled view of the electrical connector assembly shown in FIG. 2, shown both of the load plate and the first load lever in an opened position.
Figure 6:
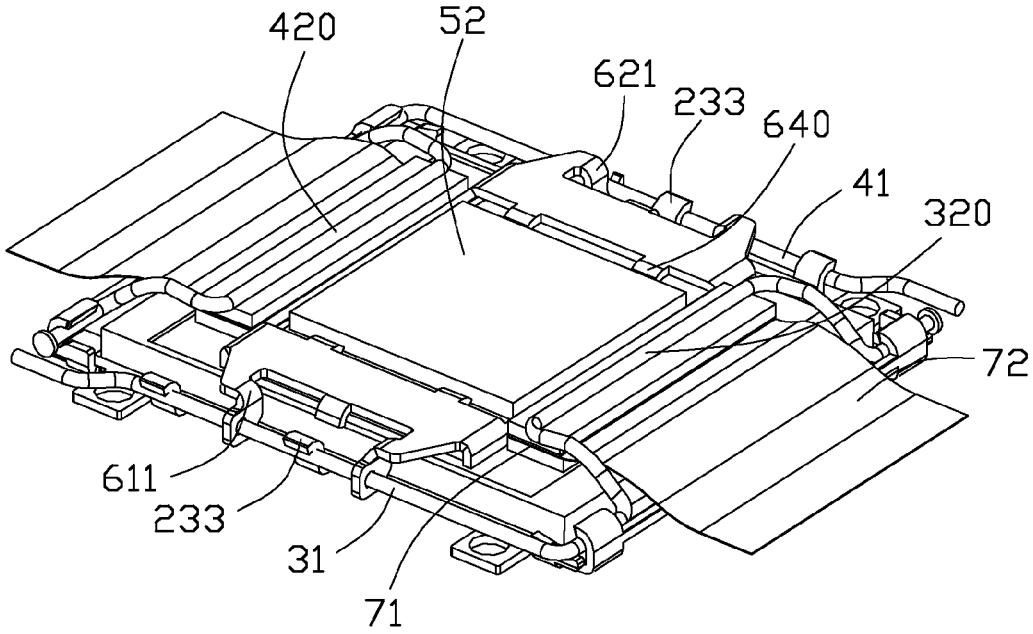
FIG. 6 is an assembled view of the electrical connector assembly shown in FIG. 2, shown both of the load plate and the first load lever in a closed position.
Figure 7:
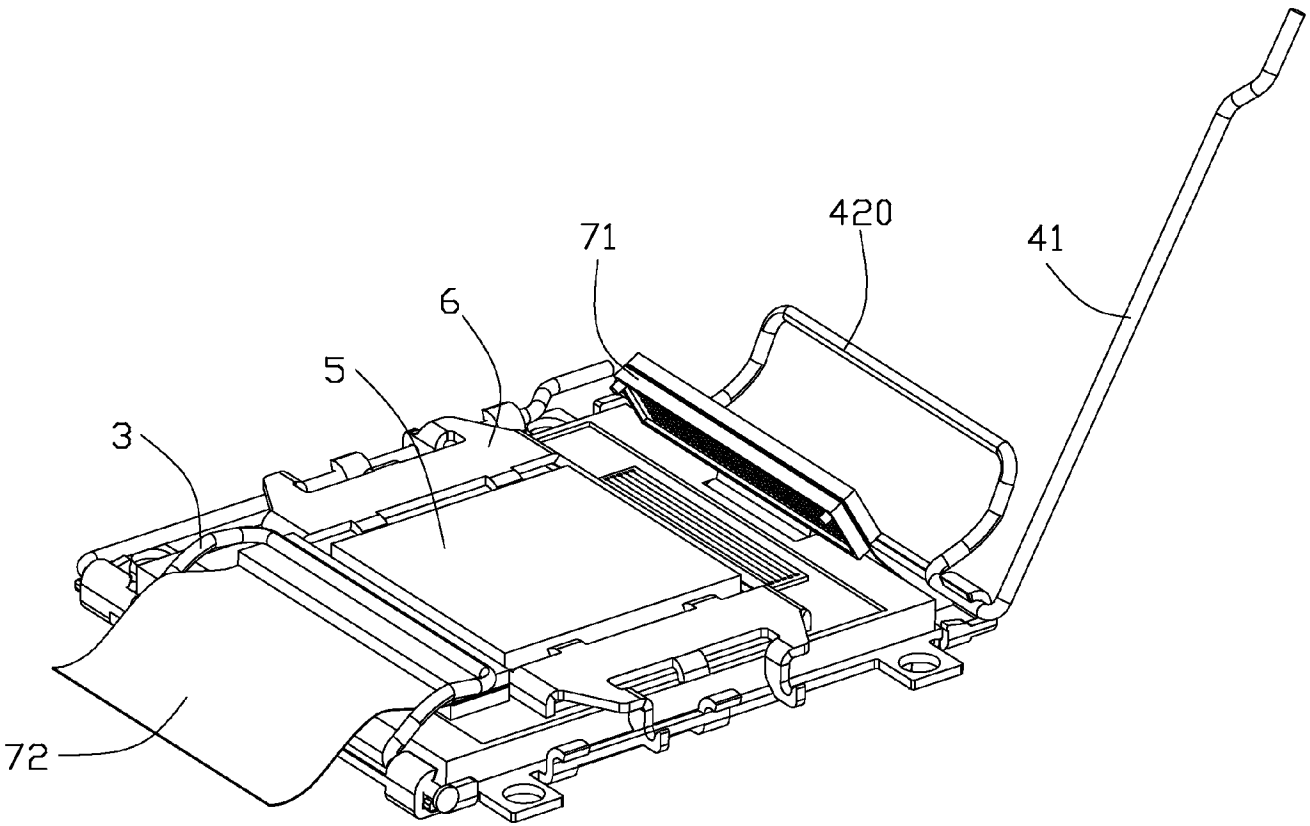
FIG. 7 is an assembled view of the electrical connector assembly shown in FIG. 2, shown the first load lever in an opened position and the cable connector removed from the CPU.

Referring to FIGS. 4-6, when the electrical connector 100 is assembled, the shaft 7120 of the cable connector 71 is received in the sunken portion 11 of the insulative housing 1, the protruding point 7121 of the cable connector 71 is received in the recess 110 of the insulative housing 1, the stiffener 2 surrounds the insulative housing 1, the first load lever 4 is assembled to the first end 21 of the stiffener 2, the second load lever 3 is assembled to the second end 22 of the stiffener 2, the cover 6 is assembled to the second load lever 3. Now introduce the operation step to assemble the CPU 5 to the electrical connector. Firstly, rotate the cable connector 71 to an opened position and assemble the CPU to the electrical connector; secondly, rotate the cable connector 71 to a closed position to press the CPU 5; thirdly, rotate the second load lever 3 to make the second operation portion 31 interlock with the interlock portions 233 of the stiffener 2, the second press portion 320 presses on the cable 72, and rotate the cover 6 to make it press the CPU 5; finally, rotate the first load lever 4 to make the first operation portion 41 interlock with the interlock portions 233 and the hook portions 621, make the cover 6 press the CPU 5 tightly.

The first press portion 420 of the first load lever 4 and the second press portion 320 of the second load lever 3 press the cable 72 to make a robust electrical connection between the cable 72 and the CPU 5. The side portions 63 of the cover 6 press the body portion 51 of the CPU 5 and the engage portion 640 of the cover 6 presses on the second step portion 52 of the CPU 5 to make a robust electrical connection between the CPU 5 and the contacts 12 received in the insulative housing 1. The first operation portion 41 of the first load lever 4 presses on the tongue portions 621 of the cover 6 to make the cover 6 press the CPU 5 tightly. The interlock portion 233 locates in the middle of the pair of retention portions 611 to make the side portions 63 of the cover 6 being assembled between the cable 72 and the first step 51 of the CPU 5 accurately.

When want to remove the cable connector 71 from the CPU 5, only need to rotate the cable connector 71 to an opened position, not need to use a large force to remove it. It is easy to operate and can protect the terminals 711 from being damaged.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector assembly for electrically connecting a CPU with a printed circuit board, comprising:

a housing assembly with a plurality of contacts received therein;

a cable connector rotatably assembled to the housing assembly and comprising a gate rotatably assembled to the housing assembly and a plurality of terminals assembled in the gate, the gate comprising a shaft assembled to the housing assembly and the gate rotated around the shaft; and a cable soldered to the terminals of the cable connector.

2. The electrical connector assembly as claimed in claim 1, wherein the housing assembly comprises an insulative housing with a sunken portion and a recess connected with the sunken portion.

3. The electrical connector assembly as claimed in claim 2, wherein the shaft is received in the sunken portion and comprises a pair of protruding points received in the recess.

4. An electrical connector assembly, comprising:

an electrical connector comprising a plurality of contacts;

a CPU assembled to the electrical connector and electrically connected with the contacts; and a pair of cable connectors assembled to two opposite sides of the electrical connector and pressed on the CPU, each of the cable connector comprising a gate rotatably assembled to the electrical connector and a plurality of terminals assembled in the gate to connect with the CPU; and a pair of cables connected with the pair of cable connectors and an electrical path being established between the pair of cables and CPU.

5. The electrical connector assembly as claimed in claim 4, wherein each of the terminals comprises a spring contact portion deformed in a vertical direction to contact with the CPU.

6. The electrical connector assembly as claimed in claim 4, wherein the housing assembly comprises an insulative housing with a sunken portion and a recess connected with the sunken portion, and the gate comprises a shaft received in the sunken portion and a pair of protruding points received in the recess.

7. The electrical connector assembly as claimed in claim 4, wherein the electrical connector comprises a first load lever and a second load lever assembled to two opposite ends of the housing assembly, both of the first load lever and the second load lever comprises a press portion and an operation portion connected with the press portion, the press portion presses the cable.

8. The electrical connector assembly as claimed in claim 7, wherein the electrical connector assembly further comprises a cover pivotally assembled to the operation portion of the second load lever and pressed by the first load lever.

9. The electrical connector assembly as claimed in claim 8, wherein the cover comprises a front end, a rear end and a pair of side portions connecting the front end and the rear end, the side portions press the CPU.

10. The electrical connector assembly as claimed in claim 9, wherein the front end comprises a retention portion to be assembled to the second operation portion of the second load lever.

11. The electrical connector assembly as claimed in claim 10, wherein the rear end comprises a tongue portion extending outwardly to be pressed by the first operation portion of the first load lever.

12. The electrical connector assembly as claimed in claim 4, wherein the cable is soldered to the terminals of the cable connector.

13. An electrical connector assembly for use with an electronic package, comprising:

a housing assembly defining a receiving region for receiving the electronic package;

a plurality of contacts equipped within the housing assembly with contacting sections upwardly extending into the receiving region for contacting the electronic package;

a lever associated with the housing assembly in a rotational manner between open and closed positions and defining a first pressing section and a second pressing section;

a cover moveable relative to the housing assembly to cover or expose the receiving region; and a cable connector assembly associatively moveable relative to the housing assembly for electrical connection between the electrical package and a cable; wherein when the cover is moved to the closed position, the first pressing section retains the cover in position for holding the electronic package in position with regard to the housing assembly, and the second pressing section directly presses the cable connector assembly in position for assuring electrical connection between the electronic package and the cable.

14. The electrical connector assembly as claimed in claim 13, wherein the cover associated with one of the housing assembly and the lever in another rotational manner.

15. The electrical connector assembly as claimed in claim 13, wherein the lever defines a rotation shaft, about which said lever perform the rotational manner, and an operation shaft, on which the lever is manually operated, essentially perpendicular to each other, and the first pressing section is located on the operation shaft while the second pressing section is located on the rotation shaft.

16. The electrical connector assembly as claimed in claim 15, wherein said cover is pivotally mounted on the operation shaft.

17. The electrical connector assembly as claimed in claim 13, further including another lever associated with the housing assembly in another rotational manner, and equipped with another first pressing section for retaining the cover and then holding the electronic package in position with regard to the housing assembly, and another second pressing section for directly pressing another cable connector assembly for electrical connection between the electronic package and another cable.

18. The electrical connector assembly as claimed in claim 17, wherein each of said lever and said another lever defines generally a right angle configuration while commonly surrounding four sides of the housing assembly.

19. The electrical connector assembly as claimed in claim 17, wherein said cover is pivotally mounted upon said another first pressing section of said another lever.

* * * * *